US010484774B2

(12) United States Patent
Silver et al.

(10) Patent No.: US 10,484,774 B2
(45) Date of Patent: Nov. 19, 2019

(54) ACOUSTIC TRANSDUCER

(71) Applicant: Bose Corporation

(72) Inventors: Jason Silver, Framingham, MA (US); Roman Litovsky, Newton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/135,223

(22) Filed: Sep. 19, 2018

(65) Prior Publication Data

US 2019/0020940 A1 Jan. 17, 2019

Related U.S. Application Data

(63) Continuation of application No. 15/375,119, filed on Dec. 11, 2016.

(51) Int. Cl.

| | |
|---|---|
| ***H04R 1/10*** | (2006.01) |
| ***H04R 1/28*** | (2006.01) |
| ***H04R 1/34*** | (2006.01) |
| ***H04R 1/38*** | (2006.01) |

(52) U.S. Cl.

CPC ..... *H04R 1/1008* (2013.01); *H04R 1/1075* (2013.01); *H04R 1/1091* (2013.01); *H04R 1/2834* (2013.01); *H04R 1/2857* (2013.01); *H04R 1/347* (2013.01); *H04R 1/2888* (2013.01); *H04R 1/38* (2013.01)

(58) Field of Classification Search

CPC .. H04R 1/1008; H04R 1/1075; H04R 1/1091; H04R 1/2834; H04R 1/2857; H04R 1/347; H04R 1/2888; H04R 1/38

USPC ..... 381/370

See application file for complete search history.

(56) References Cited

U.S. PATENT DOCUMENTS

| | | | | |
|---|---|---|---|---|
| 6,169,811 | B1 * | 1/2001 | Croft, III | H04R 1/2842 181/144 |
| 9,510,077 | B2 * | 11/2016 | Howes | H04R 1/1016 |
| 2009/0220113 | A1 * | 9/2009 | Tiscareno | H04R 1/403 381/309 |
| 2009/0288911 | A1 * | 11/2009 | Chen | H04M 1/035 181/199 |

FOREIGN PATENT DOCUMENTS

| | | | | |
|---|---|---|---|---|
| DE | 102016103477 A1 * | 8/2017 | | G10K 11/175 |
| GB | 2517486 A * | 2/2015 | | H04R 1/2857 |

* cited by examiner

*Primary Examiner* — Sean H Nguyen
(74) *Attorney, Agent, or Firm* — Brian M. Dingman; Dingman IP Law, PC

(57) ABSTRACT

An acoustic transducer with an acoustic element that emits or receives front-side acoustic radiation from its front side, and emits or receives rear-side acoustic radiation from its rear side. A housing directs the front-side acoustic radiation and the rear-side acoustic radiation. A plurality of sound-conducting vents in the housing allow sound to enter the housing or allow sound to leave the housing. A distance between vents defines an effective length of an acoustic dipole. The housing and its vents are constructed and arranged such that the effective dipole length is frequency dependent.

16 Claims, 11 Drawing Sheets

ACOUSTIC TRANSDUCER

CROSS-REFERENCE TO RELATED APPLICATION

This application is a continuation of and claims priority to application Ser. No. 15/375,119, filed on Dec. 11, 2016.

BACKGROUND

This disclosure relates to an acoustic transducer.

Off-ear headphones allow the user to be more aware of the environment, and provide social cues that the wearer is available to interact with others. However, since the acoustic transducer(s) of off-ear headphones are further from the ear and do not confine the sound to the just the ear, off-ear headphones produce more sound spillage that can be heard by others, as compared to on-ear headphones. Spillage can detract from the usefulness and desirability of off-ear headphones.

SUMMARY

All examples and features mentioned below can be combined in any technically possible way.

In one aspect, an acoustic transducer includes an acoustic element that emits or receives front-side acoustic radiation from or to its front side, and emits or receives rear-side acoustic radiation from or to its rear side. A housing directs the front-side acoustic radiation and the rear-side acoustic radiation. A plurality of sound-conducting vents in the housing allow sound to enter the housing or allow sound to leave the housing. A distance between vents defines an effective length of an acoustic dipole of the transducer. The housing and its vents are constructed and arranged such that the effective dipole length is frequency dependent. In one example the transducer is a loudspeaker with an acoustic radiator that emits acoustic radiation. In another example the transducer is a microphone with a diaphragm that receives acoustic radiation.

In another aspect, a loudspeaker includes an acoustic radiator that emits front-side acoustic radiation from its front side, and emits rear-side acoustic radiation from its rear side, a housing that directs the front-side acoustic radiation and the rear-side acoustic radiation, and a plurality of sound-emitting vents in the housing, where a distance between vents defines an effective length of a loudspeaker dipole. The housing and its vents are constructed and arranged such that the effective dipole length is frequency dependent.

Embodiments may include one of the following features, or any combination thereof. The effective dipole length may be larger at lower frequencies than it is at higher frequencies. A vent may comprise an opening in the housing covered by a resistive screen. A vent may comprise a port opening. The loudspeaker may further comprise an acoustic transmission line between the acoustic radiator and a vent. The loudspeaker may further comprise a structure for wearing the loudspeaker on a wearer's head, wherein the acoustic radiator is held near but not covering an ear of the user when the loudspeaker is worn on the user's head. First, second and third vents may comprise first, second and third port openings, respectively, wherein the first port opening receives either the front-side acoustic radiation or the rear-side acoustic radiation, and the second and third port openings both receive either the front-side acoustic radiation or the rear-side acoustic radiation but do not receive the same acoustic radiation as does the first port opening. The loudspeaker may further comprise a vented acoustic transmission line that receives either the front-side acoustic radiation or the rear-side acoustic radiation but does not receive the same acoustic radiation as does the first port opening, wherein the second port opening is in the acoustic transmission line proximate the acoustic radiator and the third port opening is in the acoustic transmission line farther from the acoustic radiator than is the second port opening.

Embodiments may include one of the following features, or any combination thereof. A first vent may comprise a first opening in the housing covered by a resistive screen, and a second vent may comprise a second opening in the housing. The first and second vents may both receive either the front-side acoustic radiation or the rear-side acoustic radiation. The loudspeaker may further comprise a third sound-emitting vent in the housing, wherein the third vent receives either the front-side acoustic radiation or the rear-side acoustic radiation but does not receive the same acoustic radiation as do the first and second vents. The third vent may comprise an opening at an end of a port that is defined by port walls, and the loudspeaker may further comprise a structure in the port that reduces port standing wave resonances. The structure in the port that reduces port standing wave resonances may comprise an opening in a port wall that is covered by a resistive screen. The loudspeaker may further comprise a vented acoustic transmission line that receives either the front-side acoustic radiation or the rear-side acoustic radiation that is not received by the first and second vents. The loudspeaker may further comprise a structure for wearing the loudspeaker on a wearer's head, wherein the acoustic radiator is held near but not covering an ear of the user when the loudspeaker is worn on the user's head, and wherein the first vent and the acoustic transmission line vent are both directed toward the ear.

Embodiments may include one of the following features, or any combination thereof. The loudspeaker may further comprise third and fourth sound-emitting vents in the housing, wherein the third and fourth vents both receive either the front-side acoustic radiation or the rear-side acoustic radiation but do not receive the same acoustic radiation as do the first and second vents. The loudspeaker may further comprise a structure for wearing the loudspeaker on a wearer's head, wherein the acoustic radiator is held near but not covering an ear of the user when the loudspeaker is worn on the user's head, and wherein the first and second vents are both closer to the ear than are the third and fourth vents. All four vents may be generally co-planar. The third vent may comprise a third opening in the housing covered by a resistive screen, and the fourth vent may comprise a fourth opening in the housing.

Embodiments may include one of the following features, or any combination thereof. A vent may comprise a passive radiator. The loudspeaker may comprise two acoustic radiators, and a system for controlling a phase of the acoustic radiation emitted by each of the two acoustic radiators, where both acoustic radiators are fluidly coupled on one side thereof to a common acoustic volume, and where a first vent is fluidly coupled to the common acoustic volume, a second vent is fluidly coupled to another side of one acoustic radiator, and a third vent is fluidly coupled to another side of the other acoustic radiator.

In another aspect, a loudspeaker includes an acoustic radiator that emits front-side acoustic radiation from its front side, and emits rear-side acoustic radiation from its rear side, a housing that directs the front-side acoustic radiation and the rear-side acoustic radiation, a structure for wearing the loudspeaker on a wearer's head, wherein the acoustic radiator is held near but not covering an ear of the user when the loudspeaker is worn on the user's head, and a plurality of sound-emitting vents in the housing, where a distance between vents defines an effective length of a loudspeaker dipole. The housing and its vents are constructed and arranged such that the effective dipole length is frequency dependent, wherein the effective dipole length is larger at lower frequencies than it is at higher frequencies. A first vent comprises a first opening in the housing covered by a resistive screen, and a second vent comprises a second opening in the housing, wherein the first and second vents both receive either the front-side acoustic radiation or the rear-side acoustic radiation, and there is a third sound-emitting vent in the housing, wherein the third vent receives either the front-side acoustic radiation or the rear-side acoustic radiation but does not receive the same acoustic radiation as do the first and second vents. The third vent may comprise a third opening in the housing covered by a resistive screen.

DETAILED DESCRIPTION

Figure 1:
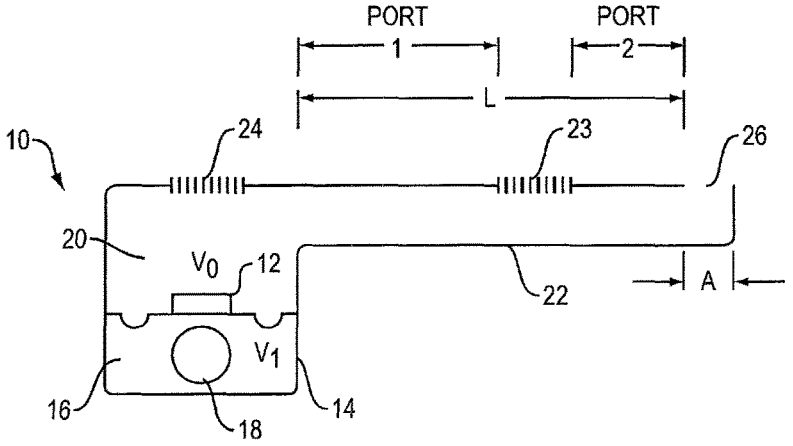
FIG. 1 is partial, schematic, cross-sectional view of a loudspeaker taken along line 1-1 of FIG. 2B.

An acoustic transducer includes an acoustic element that emits or receives front-side acoustic radiation from or to its front side, and emits or receives rear-side acoustic radiation from or to its rear side. A housing directs the front-side acoustic radiation and the rear-side acoustic radiation. A plurality of sound-conducting vents in the housing allow sound to enter the housing or allow sound to leave the housing. A distance between vents defines an effective length of an acoustic dipole of the transducer. The effective length may be considered to be the distance between the two vents that contribute most to the emitted or received radiation at any particular frequency. The housing and its vents are constructed and arranged such that the effective dipole length is frequency dependent. In one example the transducer is a loudspeaker with an acoustic radiator that emits acoustic radiation. In another example the transducer is a microphone with a diaphragm that receives acoustic radiation. When configured as a loudspeaker, the transducer is able to achieve a greater ratio of sound pressure delivered to the ear to spilled sound as compared to an off-ear headphone not having this feature. When configured as a microphone, the transducer is able to achieve a greater ratio of transduced sound pressure to noise at typical frequencies of the human voice as compared to a typical off-ear microphone.

A headphone refers to a device that typically fits around, on, or in an ear and that radiates acoustic energy into the ear canal. This disclosure describes a type of headphone that fits near, but does not block the ear, referred to as an off-ear headphone. Headphones are sometimes referred to as earphones, earpieces, headsets, earbuds, or sport headphones, and can be wired or wireless. A headphone includes an acoustic transducer driver to transduce audio signals to acoustic energy. The acoustic driver may be housed in an earcup. While some of the figures and descriptions following show a single headphone, a headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone.

In an around or on the ear or off the ear headphone, the headphone may include a headband and at least one housing that is arranged to sit on or over or proximate an ear of the user. The headband can be collapsible or foldable, and can be made of multiple parts. Some headbands include a slider, which may be positioned internal to the headband, that provide for any desired translation of the housing. Some headphones include a yoke pivotally mounted to the headband, with the housing pivotally mounted to the yoke, to provide for any desired rotation of the housing.

Exemplary loudspeaker 10 is depicted in FIG. 1, which is a schematic longitudinal cross-section. Loudspeaker 10 includes acoustic radiator 12 that is located within housing 14. Housing 14 is closed, or essentially closed, except for a number of sound-emitting vents. The housing and its vents are constructed and arranged to achieve a desired sound pressure level (SPL) delivery to a particular location, while minimizing sound that is spilled to the environment. These results make loudspeaker 10 an effective off-ear headphone. However, this disclosure is not limited to off-ear headphones, as the loudspeaker is also effective in other uses such as open-air speakers that can only be clearly heard from specific locations, which can include speakers built into the headrest or another part of a seat in an automobile, and speakers for movie theaters, arcade games and casino games, for example.

Housing 14 defines an acoustic radiator front volume 16, which is identified as "$V_1$," and an acoustic radiator rear volume 20, which is identified as "$V_0$." Acoustic radiator 12 radiates sound pressure into both volume 16 and volume 20, the sound to the two different volumes being out of phase. Housing 14 thus directs both the front side acoustic radiation and the rear side acoustic radiation. Housing 14 comprises three (and in some cases four or more) vents in this non-limiting example—front open vent 18 (which could optionally be covered by a resistive screen to make for a more ideal dipole, as is further explained below), a rear opening 24 covered by a resistive screen, such as a 19 Rayl polymer screen made by Saati Americas Corp., with a location in Fountain Inn, S.C., USA, and rear port opening 26 which is located at the distal end of port (i.e., acoustic transmission line) 22. An acoustic transmission line is a duct that is adapted to transmit sound pressure, such as a port or an acoustic waveguide. A port and a waveguide typically have acoustic mass. Second rear opening 23 covered by a resistive screen is an optional active element that can be included to damp standing waves in port 22, as is known in the art. Without screened opening 23, at the frequency where the port length equals half the wavelength, the impedance to drive the port is very low, which would cause air to escape through the port rather than screened opening 24. When screened opening 23 is included the distances along port 22 may be broken down into distance "port 1" from the entrance of port 22 to opening 23, and distance "port 2" from opening 23 to opening 26. Note that any acoustic opening has a complex impedance, with a resistive (energy dissipating) component and a reactive (non-dissipating) component. When we refer to an opening as resistive, we mean that the resistive component is dominant.

A front vent and a rear vent radiate sound to the environment outside of housing 14 in a manner that can be equated to an acoustic dipole. One dipole would be accomplished by vent 18 and vent 24. A second, longer, dipole would be accomplished by vent 18 and vent 26. An ideal acoustic dipole exhibits a polar response that consists of two lobes, with equal radiation forwards and backwards along a radiation axis, and no radiation perpendicular to the axis. Loudspeaker 10 as a whole exhibits acoustic characteristics of an approximate dipole, where the effective dipole length or moment is not fixed, i.e., it is variable. The effective length of the dipole can be considered to be the distance between the two vents that contribute the most to acoustic radiation at any particular frequency. In the present example, the variability of the dipole length is frequency dependent. Thus, housing 14 and vents 18, 24 and 26 are constructed and arranged such that the effective dipole length of loudspeaker 10 is frequency dependent. Frequency dependence of a variable-length dipole and its effects on the acoustic performance of a loudspeaker are further described below. The variability of the dipole length has to do with which vents dominate at what frequencies. At low frequencies vent 26 dominates over vent 24, and so the dipole length is long. At high frequencies, vent 24 dominates (in volume velocity) over vent 26, and so the dipole spacing is short.

One or more vents on the front side of the transducer and one or more vents on the rear side of the transducer create dipole radiation from the loudspeaker. When used in an open personal near-field audio system (such as with off-ear headphones), there are two main acoustic challenges that are addressed by the variable-length dipole loudspeakers of the present disclosure. Headphones should deliver sufficient SPL to the ear, while at the same time minimizing spillage to the environment. The variable length dipoles of the present loudspeakers allow the loudspeaker to have a relatively large effective dipole length at low frequencies and a smaller effective dipole length at higher frequencies, with the effective length relatively smoothly transitioning between the two frequencies. For applications where the sound source is placed near but not covering an ear, what is desired is high SPL at the ear and low SPL spilled to bystanders (i.e., low SPL farther from the source). The SPL at the ear is a function of how close the front and back sides of the dipole are to the ear canal. Having one dipole source close to the ear and the other far away causes higher SPL at the ear for a given driver volume displacement. This allows a smaller driver to be used. However, spilled SPL is a function of dipole length, where larger length leads to more spilled sound. For a headphone, in which the driver needs to be relatively small, at low frequencies driver displacement is a limiting factor of SPL delivered to the ear. This leads to the conclusion that larger dipole lengths are better at lower frequencies, where spillage is less of a problem because humans are less sensitive to bass frequencies as compared to mid-range frequencies. At higher frequencies, the dipole length should be smaller.

Figures 2A, 2B:
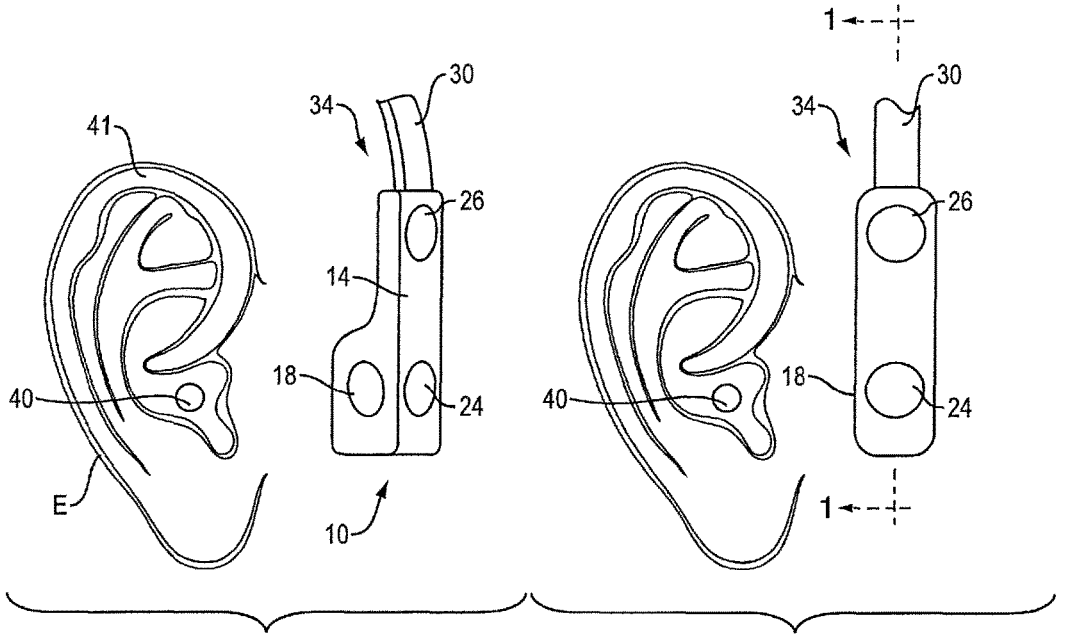
FIGS. 2A and 2B are front perspective and side views of the loudspeaker of FIG. 1 in use near the ear of a user.

In some non-limiting examples herein, the loudspeaker is used to deliver sound to an ear of a user, for example as part of a headphone. An exemplary headphone 34 is depicted in FIGS. 2A and 2B. Loudspeaker 10 is positioned to deliver sound to ear canal 40 of ear E with pinna 41. Housing 14 is carried by headband 30, such that the acoustic radiator is held near but not covering the ear. Other details of headphone 34 that are not relevant to this disclosure are not included, for the sake of simplicity. Front vent 18 is closer to ear canal 40 than are back vents 24 and 26. Vent 18 is preferably located anteriorly of pinna 41 and pointed toward and close to the ear canal, so that sound escaping vent 18 is not blocked by or substantially impacted by the pinna before it reaches the ear canal. As can be seen in the side view of FIG. 2B, vents 24 and 28 are directed directly away from the user's head. The area of the vents 18, 24, and 26 should be large enough such that there is minimal flow noise due to turbulence induced by high flow velocity. Note that this arrangement of vents is illustrative of principles herein and is not limiting of the disclosure, as the location, size, shape, impedance, and quantity of vents can be varied to achieve particular sound-delivery objectives, as would be apparent to one skilled in the art.

One side of the acoustic radiator (the front side in the example of FIGS. 1 and 2) radiates through a vent that is close to the ear canal. The other side of the driver can force air through a screen, or down a port. When the impedance of the port is high (at relatively high frequencies), acoustic pressure created at the back of the radiator escapes primarily through the screen. When the impedance of the port is low (at relatively low frequencies), the acoustic pressure escapes primarily through the end of the port. Thus, placing the screened vent closer than the port opening to the front vent accomplishes a longer effective dipole length at lower frequencies, and a smaller effective dipole length at higher frequencies. The housing and vents of the present loudspeaker are preferably constructed and arranged to achieve a longer effective dipole length at lower frequencies, and a smaller effective dipole length at higher frequencies.

Figure 3:
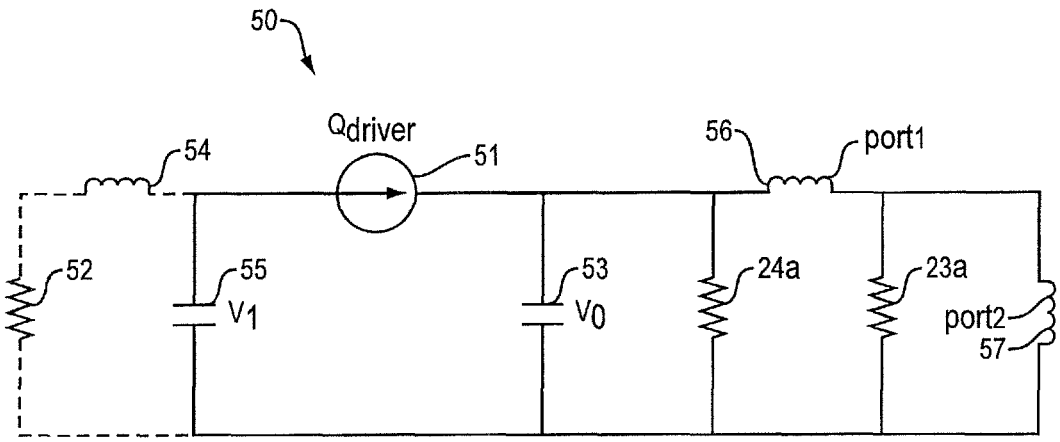
FIG. 3 is an electrical equivalent diagram of the loudspeaker of FIG. 1.

FIG. 3 is an electrical equivalent diagram or model 50 of the loudspeaker of FIG. 1. Radiator 12 is modeled as volume velocity source 51 with volume velocity $Q_{driver}$. The back volume 20 ($V_0$), from which back acoustic radiation exits via opening 26, is modeled as capacitor 53, screened opening 24 is modeled as resistor 24*a*, and port 22 with opening 26 is modeled as inductances 56 (for portion "port1") and 57 (for portion "port2"). The front volume 16 ($V_1$), into which front acoustic radiation is directed, is modeled as capacitor 55. If front vent is open, it is assumed to have zero impedance and so is not reflected in the model. However, the front side may have a screened opening (modeled as optional resistor 52) and/or a port, (modeled as optional inductance 54).

Figure 4:
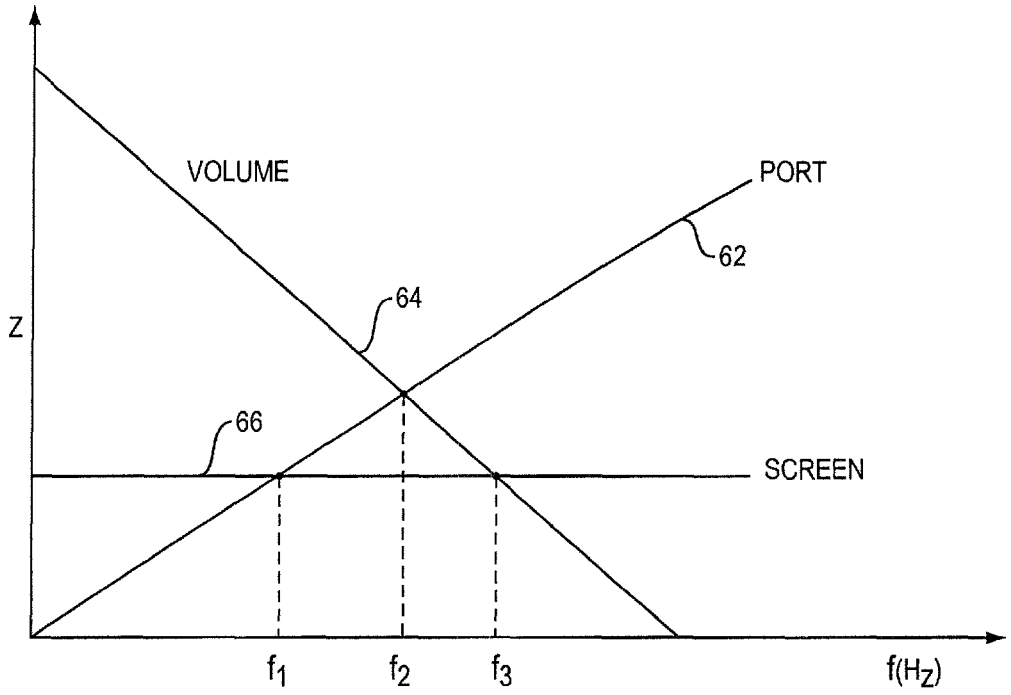
FIG. 4 is plot of impedance v. frequency for a representative example of the loudspeaker of FIG. 1.

FIG. 4 is a plot of the magnitude of the impedance (Z) v. frequency (f) for the back side of a representative example of the loudspeaker of FIG. 1, and as modeled by model 50, FIG. 3. A lower impedance equates to greater outputted volume velocity. At any particular frequency, the output from any or all of the back-side vents can contribute to the sound emitted from the loudspeaker. However, at most frequencies the impedance of one of the back-side vents will be lower than that of the others, and thus the sound pressure delivered from that vent, as well as the front-side vent, will dominate the loudspeaker output.

At relatively low frequencies, up to frequency f1, the loudspeaker back-side output is dominated by port opening 26, curve 62. Curve 62 can have a value that is proportional to L/A, where L is the length of port 22 and A is the area of port opening 26. Above frequency f1, the loudspeaker back-side output is dominated by screened opening 24, curve 66. The impedance (Z) of the screen is constant with frequency. At frequency 12, the port and volume resonate which cause the driver cone's motion to be lessened or stopped, especially when the damping due to the screen(s) is low. This results in more volume velocity from the back side than the front side (opening 18), and a non-ideal dipole. Above frequency f3, the loudspeaker back-side output is still dominated by the screen, however due to the low impedance of the back volume (64), much of the driver volume velocity is absorbed by the volume and less comes out the screen. In one exemplary non-limiting example, frequency f1 is about 650 Hz, frequency f2 is about 3,050 Hz and frequency f3 is about 16,000 Hz.

Figure 5:
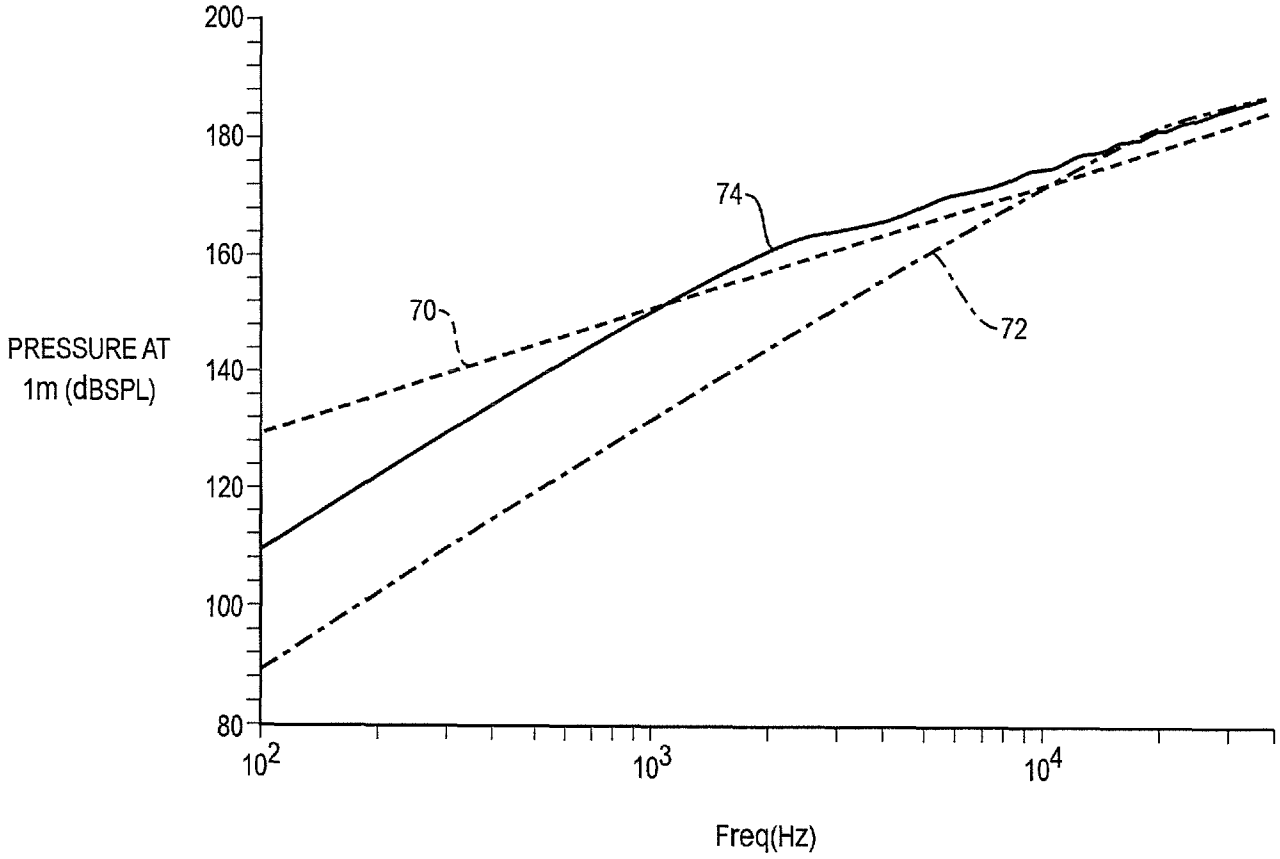
FIG. 5 is a plot of spillage (sound pressure) v. frequency for a monopole acoustic volume velocity source and two different dipole volume velocity sources.

FIG. 5 is a plot of modelled spillage (sound pressure at 1 meter from the source) v. frequency for a monopole acoustic source (curve 70), and two different dipole sources (curves 72 and 74), all sources having a volume velocity of 1.0 cubic meter per second. The dipole of curve 74 has two ideal point sources spaced apart by 100 mm, and the dipole of curve 72 has two ideal point sources spaced apart by 10 mm. Below the frequency where the wavelength is equal to about ⅓ of the dipole spacing, the spillage from the dipoles is less than that from the monopole. Above this frequency, the spillage from the dipoles approaches 3 dB more than that from the monopole. FIG. 5 thus establishes that sound spillage can be reduced by preventing or inhibiting rear side radiation above the frequency where the wavelength is equal to about ⅓ of the dipole spacing. This can be accomplished by creating an acoustic low-pass filter on the rear. A low-pass filter can be accomplished with an acoustic volume and a resistor, which gives a first-order roll-off, or an acoustic volume and a port (with a reactance and a resistance), which approaches a second-order roll-off.

Figure 6:
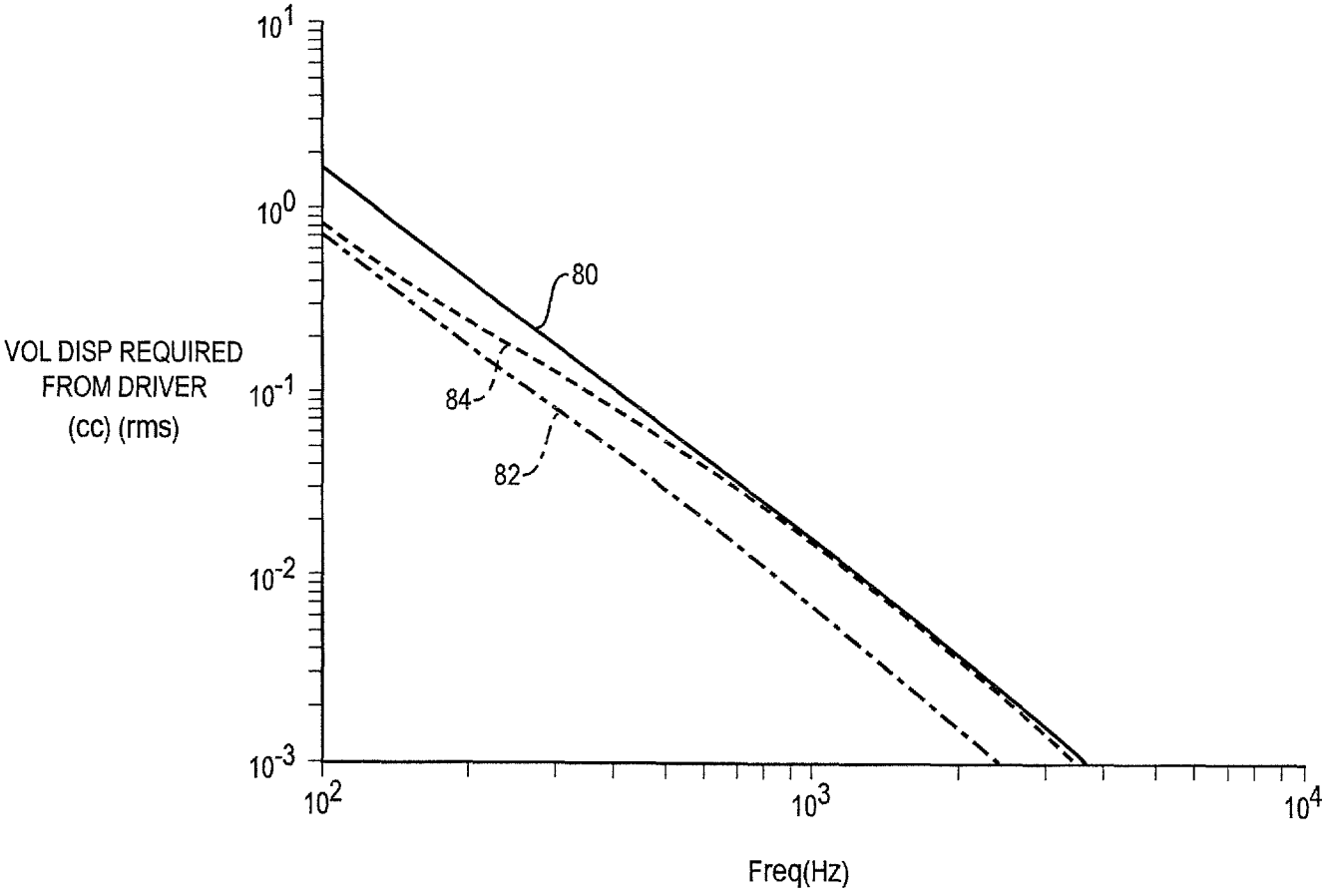
FIG. 6 is a plot of driver displacement v. frequency for an exemplary loudspeaker.
Figure 7:
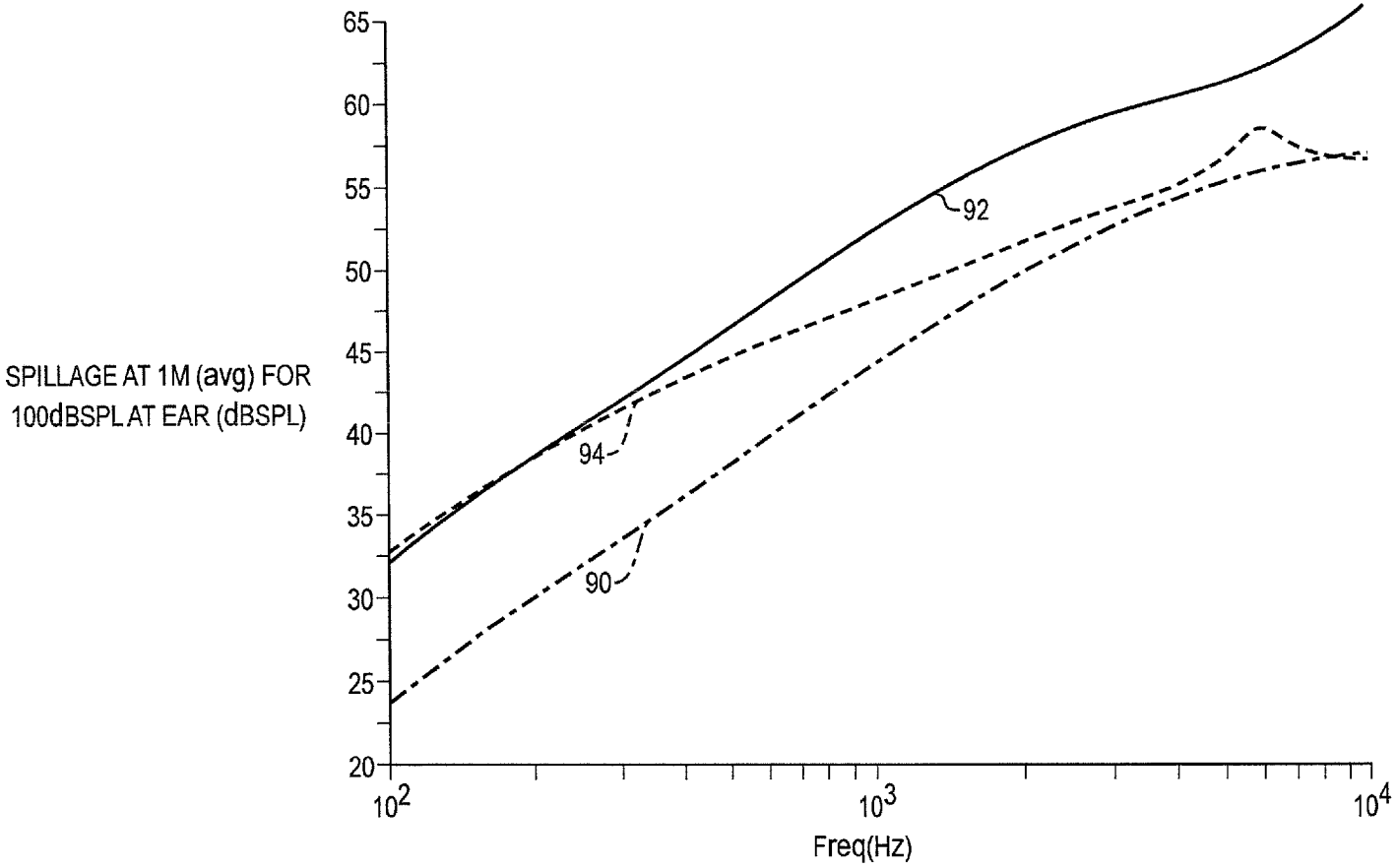
FIG. 7 is a plot of spillage v. frequency for the same exemplary loudspeaker as in FIG. 6.

FIG. 6 is a plot of driver displacement v. frequency for an exemplary idealized loudspeaker such as loudspeaker 10, FIG. 1, with four source volume velocities (front vent 18, back cavity screen 24, screen 23, and back port exit 26), curve 84. The model was simplified to make all four sources co-linear. The distances of the sources from the ear are 10, 15, 23.4 and 33.5 mm. This is compared to a dipole with a 5 mm length (curve 80) and a dipole with a 30 mm length (curve 82). In all cases the opening closest to the ear is 10 mm from the ear, and the dipole sources are assumed to all lie co-linearly along an axis from the ear. FIG. 7 is a plot of average spillage at 1 meter (for a 100 dB SPL at the ear) v. frequency, for the same exemplary loudspeaker and two dipoles as in FIG. 6. These curves establish that variable effective dipole length of the subject loudspeakers can accomplish a greater dipole spacing at lower frequencies, and a smaller dipole spacing at higher frequencies.

Figure 8A:
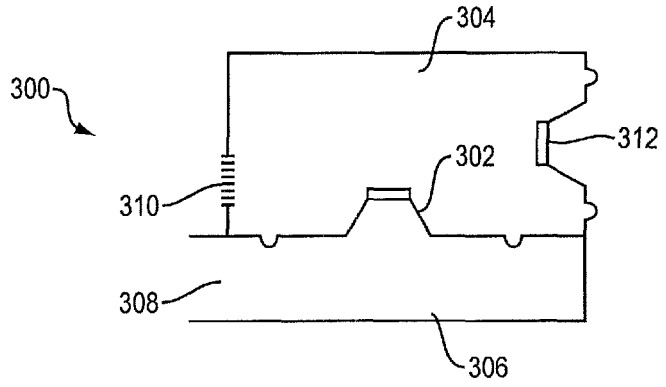
FIG. 8A is a schematic cross-sectional view of a loudspeaker.
Figure 8B:
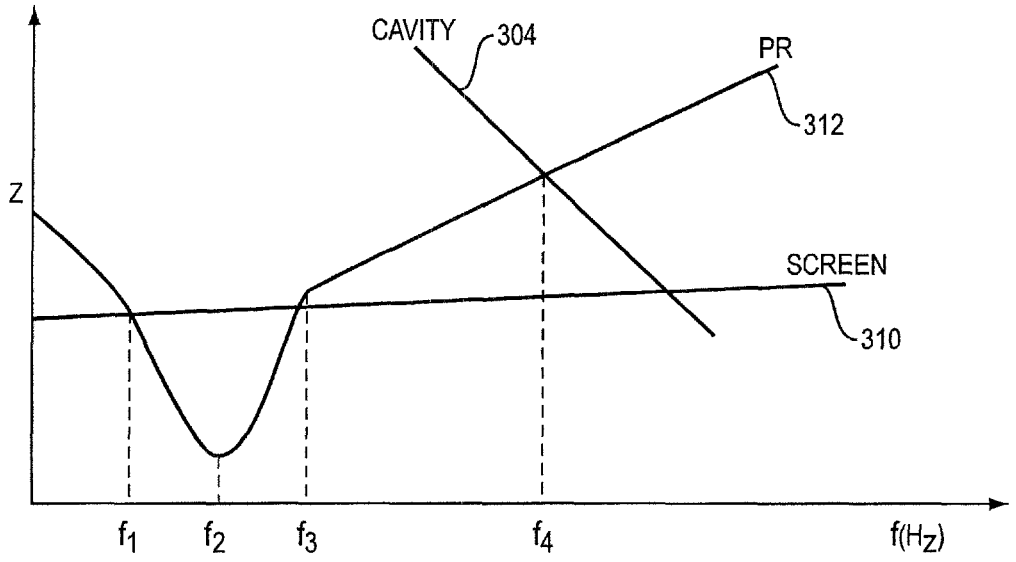
FIG. 8B is a plot of impedance v. frequency for the loudspeaker of FIG. 8A.

FIG. 8A is a schematic cross-sectional view of a loudspeaker 300 that uses a passive radiator 312 as one of the vents. The passive radiator makes the variable length dipole transition more abrupt as compared to a port (as was used in the example of FIG. 1). FIG. 8B is a plot of impedance v. frequency for the back side of loudspeaker 300 of FIG. 8A. Loudspeaker 300 has driver 302. Volume velocity on one side (the front side in this non-limiting example) is directed into front volume 306 and out through port vent 308. The other side (the back side) volume velocity is directed into back volume 304, and is able to create sound pressure outside of the loudspeaker via screened opening 310 and/or passive radiator 312. Passive radiators are well known in the acoustics field and so will not be further described herein.

The back-side impedances are plotted in FIG. 8B. Up to frequency $f_1$ the volume velocity is dominated by screen 310. From $f_1$ to $f_3$ the volume velocity is dominated by passive radiator (PR) 312. Since PR 312 is spaced much farther from front opening 308 than is screened opening 310, the PR creates a much larger dipole than the screen. Above frequency $f_3$ an increasing amount of the back-side volume velocity exits via screen 310, thus reducing the dipole length.

Figure 9A:
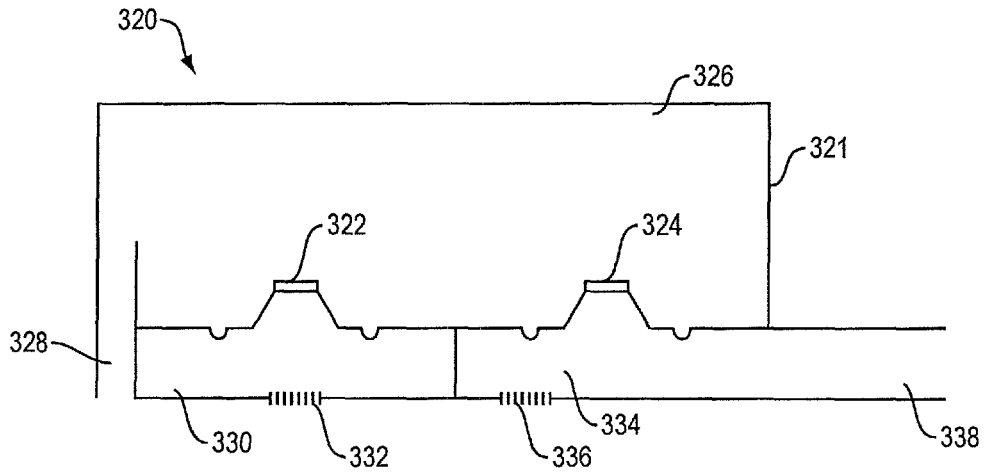
FIG. 9A is a schematic cross-sectional view of a loudspeaker.

The acoustic transducer can have more than one driver (or more than one microphone diaphragm). For example, loudspeaker 320, FIG. 9A, includes drivers 322 and 324 located in housing 321. The common back volume 326 is vented by port 328, which is on the same side of housing 321 as are front screened openings 332 and 336, where screen 332 is at the front side of driver 322 and screen 336 is at the front side of driver 324. The front volume 334 of driver 324 is also vented 338, at a location that is farther spaced from back vent 328 than are front screens 332 and 336, so as to create a variable length dipole.

Figure 9B:
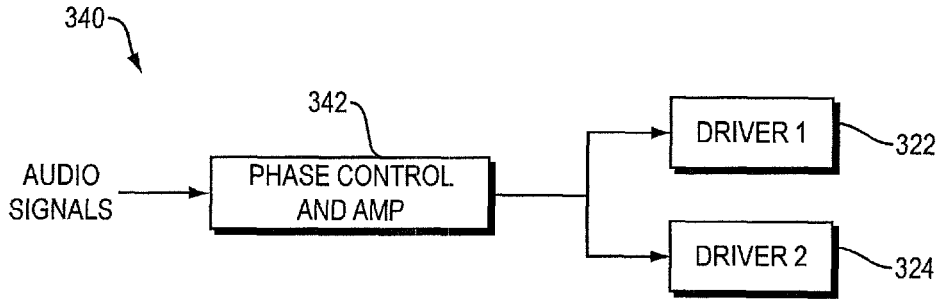
FIG. 9B is a schematic block diagram of a control system for the loudspeaker of FIG. 9A.

System 340, FIG. 9B, can be used to control loudspeaker 320. Audio signals are inputted to phase control and amplifier system 342, which sends appropriate audio signals to driver 1 (322) and driver 2 (324). In one exemplary use, at low frequencies drivers 322 and 324 are played in-phase. This pressurizes back volume 326 at the tuning frequency of port 328, and creates more volume velocity than the driver cones can move. Driver 324 vents to port 338. At upper bass/mid/high frequencies, system 342 is used to play the drivers out of phase. The result is no volume velocity at port 328. At upper bass frequencies, there is equal and opposite volume velocity from screen 332 and port 338, creating a large dipole length. At mid/high frequencies the impedance of screen 336 is lower than that of port 338, so there is more flow through screen 336 than port 338, creating a smaller dipole length (the distance between screen 332 and screen 336).

The acoustic resistance of resistive screens used to cover openings in the subject transducers can be selected to help achieve a more "ideal" dipole—one in which the volume velocity from the front and back side are closer to equal. If a driver is presumed to have equal volume velocity to its front and back, then the front and back volumes and the screens act like a filter on the respective volume velocity. To achieve equal volume velocities from front and back screened openings, the cavity volumes times the screen resistances need to be equal. Thus, the screen resistances can be selected in light of the respective cavity volumes. Similarly, if the outlets have an acoustic mass, to achieve equal volume velocities from front and back vents with acoustic mass, the cavity volumes times the acoustic masses need to be equal. Thus, the acoustic masses can be designed in light of the respective cavity volumes.

Figure 10A:
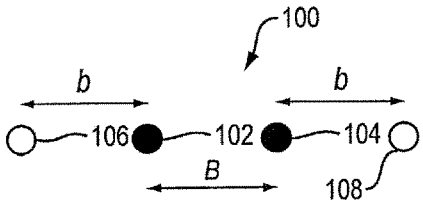
FIGS. 10A and 10B are schematic representations of two versions of the arrangements of four radiators in exemplary quadrupole loudspeakers.
Figure 10B:
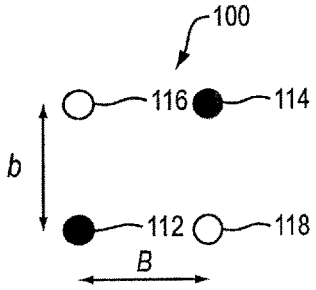
Figure 11:
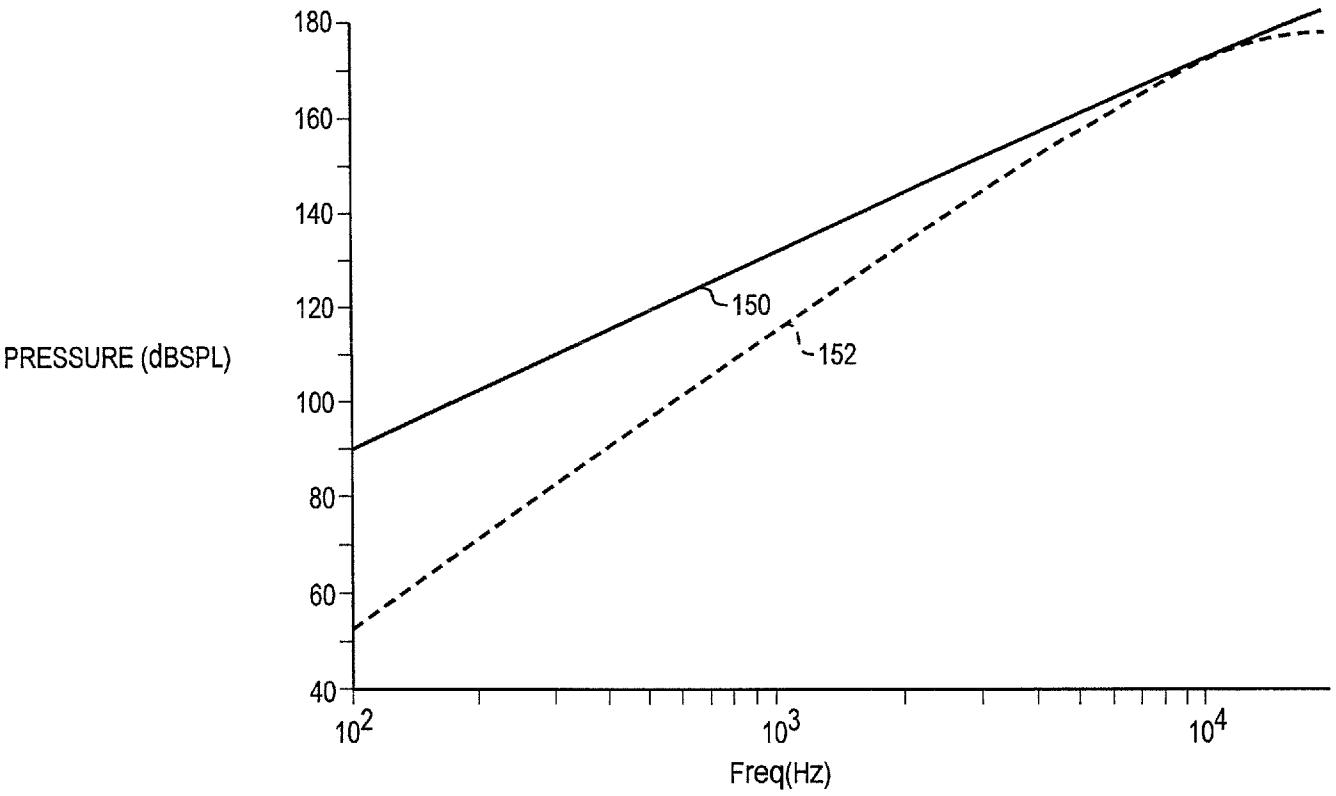
FIG. 11 is a plot of spillage (sound pressure) v. frequency for a dipole and the quadrupoles of FIGS. 10A and 10B.

An acoustic quadrupole is an acoustic element with two opposite-phase dipoles. Quadrupoles can be designed to have less far-field spillage than dipoles, so can be advantageous in the present loudspeakers. FIGS. 10A and 10B are schematic representations of two versions of the arrangements of four radiators in exemplary quadrupole loudspeakers. FIG. 11 is a plot of spillage (sound pressure) v. frequency for a dipole, and the quadrupoles of FIGS. 10A and 10B.

Linear quadrupole 100, FIG. 10A, includes point sources 102 and 106 that are out of phase with each other, and point sources 104 and 108 that are also out of phase. Sources 102 and 104 are in-phase with each other, as are sources 106 and 108. Rectangular quadrupole 110, FIG. 10B, includes point sources 112 and 116 that are out of phase with each other, and point sources 114 and 118 that are also out of phase. Sources 112 and 114 are in-phase with each other, as are sources 116 and 118.

The plot of FIG. 11 illustrates spillage at 1 m for a dipole where each source has a volume velocity of 1 cubic meter per second and spacing of 10 mm, curve 150. Also, plotted by curve 152 is spillage for the two quadrupoles of FIGS. 10A and 10B, where the linear quadrupole of FIG. 10A has a spacing where distances b and B are both 10 mm, and the square quadrupole of FIG. 10B has a spacing where distances b and B are both 18.7 mm, and where the sources all have a volume velocity of 0.5 cubic meters per second. The quadrupoles spill less radiation than the dipole below about 8 kHz, and the spilled radiation falls off as frequency decreases at about 60 dB/dec as opposed to about 40 dB/dec for the dipole.

Figure 12:
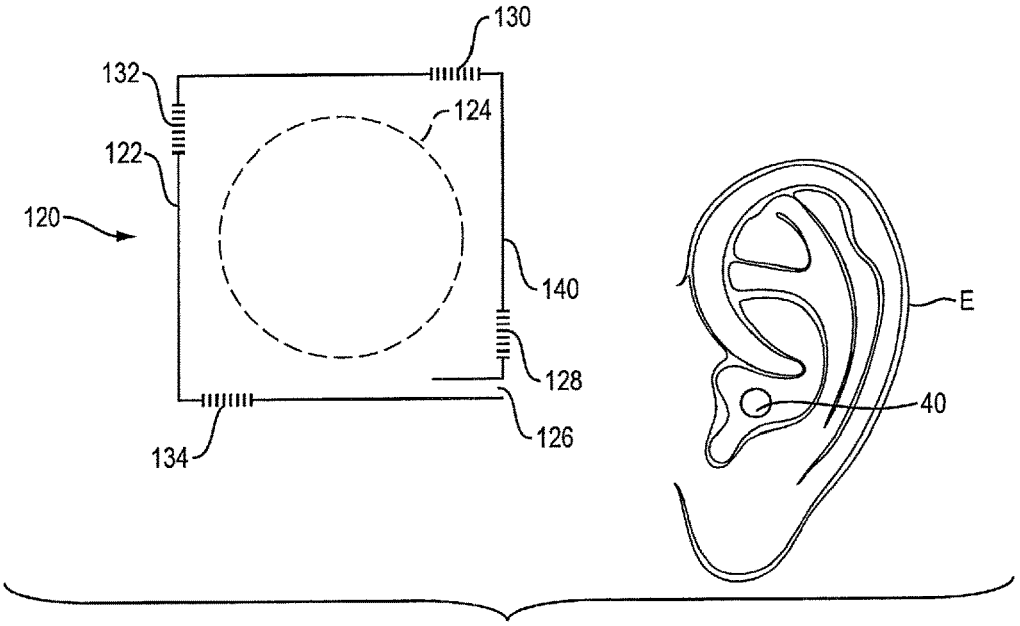
FIG. 12 is a side view of an exemplary quadrupole loudspeaker in use near an ear.
Figure 13:
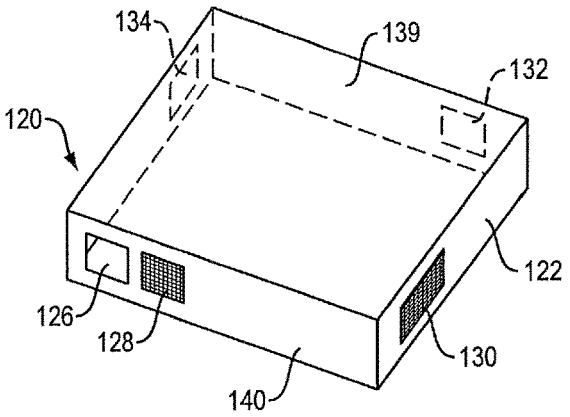
FIG. 13 is a perspective view of the loudspeaker of FIG. 12.

FIG. 12 is a schematic side view of an exemplary quadrupole loudspeaker 120, located near an ear E with ear canal 40. FIG. 13 is a perspective view of the loudspeaker 120 of FIG. 12. Port opening 126 and resistive screened opening 128 both face the ear and are both on the same side of the driver 124, preferably the front side of driver 124. Rear resistive screened opening 132 is exposed to the same side of the driver as port 126 and screen 128. Screens 130 and 134 are exposed to the other side of the driver. At low frequencies where vent 126 dominates over screened vents 128 and 132, most or all of the volume velocity from the front side of the driver comes from vent 126, thus acting like a single monopole source from the front side. At higher frequencies where vent 126 is effectively blocked due to high impedance, vent 128 and vent 134 or vent 130 form a first effective dipole of the quadrupole, while vent 132 and the other of vents 134 and 130 form the other effective dipole of the quadrupole. All vents are created in the sidewalls of housing 140, as shown in FIG. 13. The vents are all generally co-planar, in this non-limiting case lying in a plane that is generally parallel to the flat top 139 of housing 140. One other of myriad possible quadrupole designs is a linear design like that of FIG. 10A, but where the two in-phase sources 102 and 104 are replaced by a single source that is twice as strong and located halfway between sources 102 and 104. This stronger single source is located near the ear canal, and all the source are aligned along a vertical line when mounted on a head and the person is standing straight up.

Figure 14:
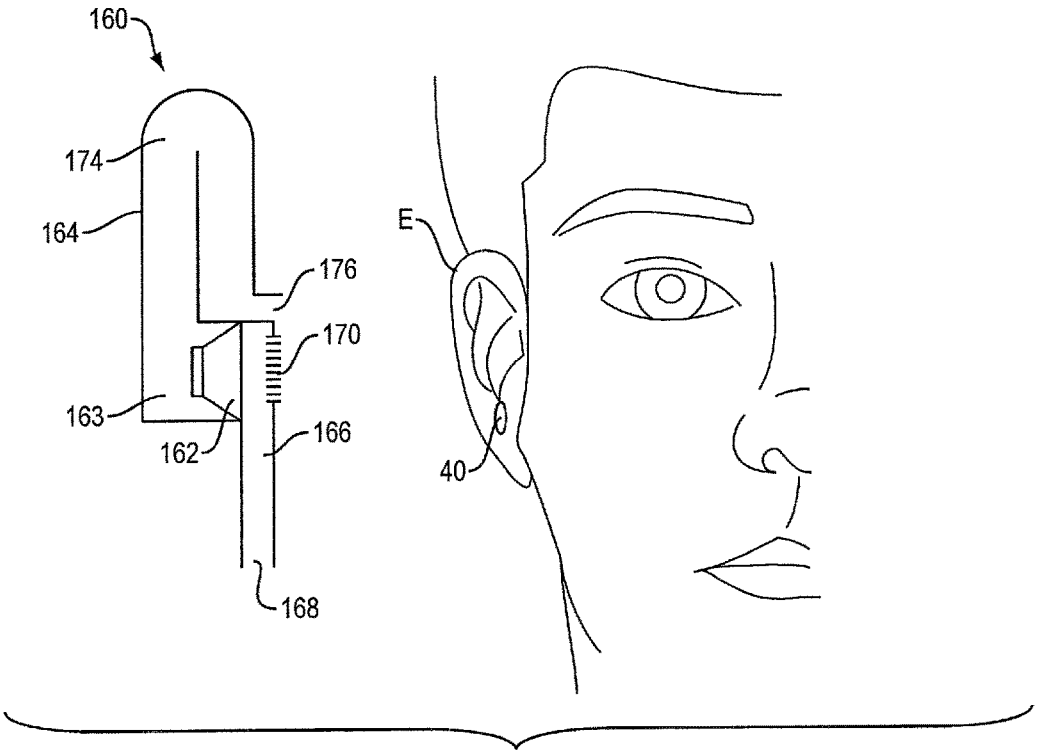
FIG. 14 is a schematic cross-sectional view of a loudspeaker in use near the ear of a user.

The loudspeakers can take myriad other forms, as would be apparent to one skilled in the art. For example, FIG. 14 is a schematic cross-sectional view of a loudspeaker 160 in use near the ear E of a user, with ear canal 40. Loudspeaker 160 is constructed and arranged to boost low frequencies, while still achieving the overall objectives of the subject loudspeaker. The back side of driver 162 is loaded with a long waveguide 174, and can include a back volume 163 which feeds waveguide 174. The front side of driver 162 vents to screened opening 170 which is close to the ear, and also a short port or waveguide 166 with its opening 168 farther from the ear. Long waveguide 174 creates a lot of volume velocity near its bass tuning frequency, even below its tuning, more than the driver cone can radiate by itself. To keep this volume velocity from canceling with front side radiation, at low frequencies the front side radiates through the short port/waveguide away from ear. At mid/high frequencies, when the waveguide output is insignificant, the front side radiates through the screen. The frequency where the front side transitions from the short waveguide/port to the screen is determined by the screen resistance and the port's acoustic impedance. When the impedance of the port is greater than that of the screen, more air will flow through the screen, and vice versa.

Figure 15:
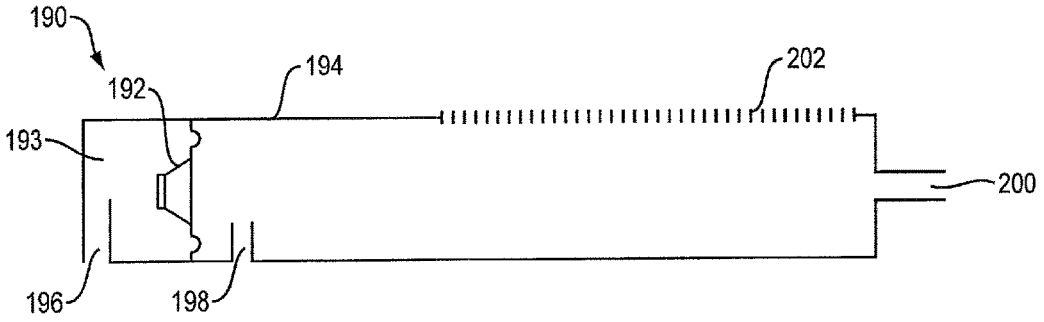
FIG. 15 is a schematic cross-sectional view of a loudspeaker.

FIG. 15 is a schematic cross-sectional view of a tapered-slot-radiating loudspeaker 190, which is also optimized to boost low frequencies. Housing 194 includes rear volume 193 and rear port 196, and front ports 198 and 200. Screen 202 allows front-side volume velocity to escape along the length of the tapered-slot-radiating loudspeaker. Port 196 allows the back of driver 192 to radiate more sound at its (bass) tuning frequency, while ports 198 and/or 200 allow the front side to radiate at mid-bass frequencies. At high frequencies, the front ports choke off and loudspeaker 190 acts more like a tapered-slot-radiating loudspeaker.

The subject acoustic transducer is not limited to a loudspeaker; the same principles can apply to another type of sound transducer, for example a microphone. By the principle of reciprocity, a dipole radiator with sources moving with volume velocity Q and with small dipole length radiates very little pressure to the far field, can also act like a dipole receiver (microphone) that for a given amount of far field pressure moves the diaphragm of the microphone very little (i.e., the microphone has low sensitivity). Similarly, a large dipole length receiver (microphone) will be more sensitivity to far field sound. And, placing a sound source, like a talker, closer to a vent that is connected to one side of a microphone diaphragm than a vent connected to the other side, will increase the sensitivity of the microphone to the near-field talker.

Figure 16:
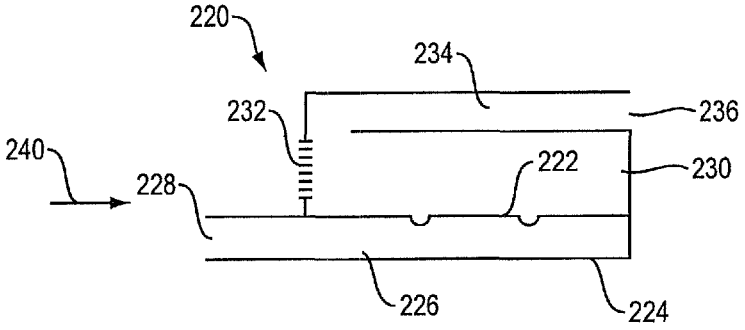
FIG. 16 is a schematic cross-sectional view of a microphone.

FIG. 16 is a schematic cross-sectional view of a variable dipole microphone 220 in accordance with the present disclosure. Microphone diaphragm 222 is located in housing 224. Sound arrives from the direction of arrow 240, and can enter port opening 228 on a first side of diaphragm 222, and also can enter through screened opening 232 on the other side of the diaphragm. Port 234 with opening 236 is located on the far side of the housing, away from the sound source. Volume 230 can also be included. When microphone 220 is used close to the sound source that is closer to vent 228 than vent 236 (e.g., as a hand-held or lapel mic, for instance), at low frequencies its response is dominated by port opening 228 and so it is sensitive to the sound (the talker), and it would also be more sensitive to ambient diffuse noise.

However, for cases in which there is a low-frequency noise environment but where the higher sensitivity to the talker is more important, microphone 220 would be a useful. At higher frequencies, the microphone is less sensitive to the talker but ambient noise delivers less signal to the diaphragm.

Figure 17:
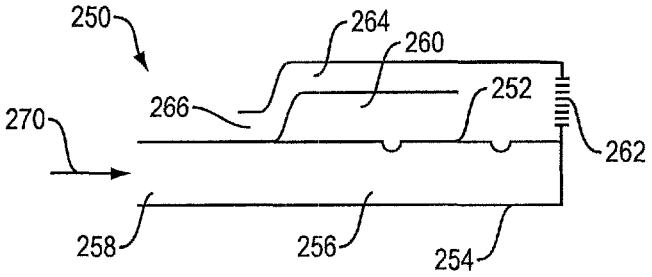
FIG. 17 is a schematic cross-sectional view of a microphone.

FIG. 17 is a schematic cross-sectional view of another variable dipole microphone 250 in accordance with the present disclosure. Microphone diaphragm 252 is located in housing 254. Sound arrives from the direction of arrow 270, and can enter port opening 258 on a first side of diaphragm 252, and also can enter through port opening 266 of port 264, which fluidly communicates with volume 260 which is on the other side of diaphragm 252. Screened opening 262 is on the other side of the diaphragm, and is located on the back side of the housing, away from the sound source. When microphone 250 is used close to the sound source that is closer to vent 258 than vent 262 (e.g., as a hand-held or lapel mic, for instance), at low frequencies its sensitivity to the talker is relatively low, but sensitivity to ambient sound is very low. At higher frequencies, the sensitivity to a talker is high, while ambient noise sensitivity is also relatively high. Accordingly, microphone 250 may be most useful in environments in which noise is at a lower frequency.

A number of implementations have been described. Nevertheless, it will be understood that additional modifications may be made without departing from the scope of the inventive concepts described herein, and, accordingly, other embodiments are within the scope of the following claims.

What is claimed is:

1. A loudspeaker, comprising:

first and second acoustic drivers that each emit front-side acoustic radiation from a front side of the driver and rear-side acoustic radiation from a rear side of the driver;

a housing that comprises a rear acoustic volume that receives the rear-side acoustic radiation of both drivers and a front acoustic volume that receives the front-side acoustic radiation of a driver;

a plurality of sound-emitting openings in the housing, wherein a distance between sound-emitting openings defines an effective length of a loudspeaker dipole, and wherein the housing and its sound-emitting openings are constructed and arranged such that the effective dipole length is frequency dependent wherein the effective dipole length is larger at lower frequencies than it is at higher frequencies;

wherein first and second rear sound-emitting openings are acoustically coupled to the rear acoustic volume and wherein first and second front sound-emitting openings are acoustically coupled to the front acoustic volume, wherein the first rear sound-emitting opening is closer to the first front sound-emitting opening than is the second rear sound-emitting opening;

a resistive screen covering the first rear sound-emitting opening; and an acoustic transmission line that is acoustically coupled to the rear acoustic volume and comprises the second rear sound-emitting opening.

2. The loudspeaker of claim 1, further comprising a structure for wearing the loudspeaker on a user's head, wherein the drivers are held near but not covering an ear of the user when the loudspeaker is worn on the user's head.

3. A loudspeaker, comprising:

a housing with an interior;

first and second acoustic drivers in the housing interior, wherein the first and second acoustic drivers each emit front-side acoustic radiation from a front side of the driver into a front volume of the housing, and rear-side acoustic radiation from a rear side of the driver into a rear volume of the housing;

a plurality of sound-emitting openings in the housing, the openings comprising a first front opening that is configured to emit front-side sound, a first rear opening that is configured to emit rear-side sound, and a second rear opening that is configured to emit rear-side sound;

wherein a first loudspeaker dipole is defined by the first front opening and the first rear opening, and a second loudspeaker dipole is defined by the first front opening and the second rear opening;

wherein the first rear opening is closer to the first front opening than is the second rear opening, so that the first loudspeaker dipole has a shorter effective length than does the second loudspeaker dipole; and a structure that carries the housing, wherein the structure is configured to be worn by a user such that the housing is not on or in the user's ear, and with the first front opening closer to the ear canal opening than the first and second rear openings, and the first rear opening closer to the ear canal opening than the second rear opening.

4. The loudspeaker of claim 3, wherein the effective dipole length is larger at lower frequencies than it is at higher frequencies.

5. The loudspeaker of claim 3, further comprising a resistive screen covering a sound-emitting opening.

6. The loudspeaker of claim 3, wherein a sound-emitting opening comprises a port opening.

7. The loudspeaker of claim 3, wherein the housing comprises a rear acoustic volume that receives the rear-side acoustic radiation of both drivers.

8. The loudspeaker of claim 7, wherein first and second rear sound-emitting openings are acoustically coupled to the rear acoustic volume.

9. The loudspeaker of claim 8, further comprising a resistive screen covering the first rear sound-emitting opening.

10. The loudspeaker of claim 8, further comprising an acoustic transmission line that is acoustically coupled to the rear acoustic volume and comprises the second rear sound-emitting opening.

11. The loudspeaker of claim 10, wherein a front sound-emitting opening receives front-side acoustic radiation, and wherein the first rear sound-emitting opening is closer to the front sound-emitting opening than is the second rear sound-emitting opening.

12. The loudspeaker of claim 7, further comprising an acoustic transmission line that is acoustically coupled to the rear acoustic volume and comprises the second rear sound-emitting opening.

13. The loudspeaker of claim 3, wherein the housing comprises a front acoustic volume that receives the front-side acoustic radiation of a driver.

14. The loudspeaker of claim 13, wherein first and second front sound-emitting openings are acoustically coupled to the front acoustic volume.

15. The loudspeaker of claim 14, further comprising a resistive screen covering one of the first and second front sound-emitting openings.

16. The loudspeaker of claim 3, further comprising wherein the structure that carries the housing is configured to be worn on a user's head, wherein the drivers are held near but not covering an ear of the user when the loudspeaker is worn on the user's head.

* * * * *